United States Patent [19]

Pommat et al.

[11] 4,322,589

[45] Mar. 30, 1982

[54] CONTROL DEVICE FOR ELECTRIC MOTOR-REDUCTION UNIT

[75] Inventors: Alain Pommat, Cluses; Pierre Fillion, Ville La Grand, both of France

[73] Assignee: Etablissements Carpano & Pons, France

[21] Appl. No.: 147,247

[22] Filed: May 6, 1980

[30] Foreign Application Priority Data

May 21, 1979 [FR] France ..... 79 13718

[51] Int. Cl.[3] ..... H01H 3/16; H01H 19/18

[52] U.S. Cl. ..... 200/30 R; 200/35 R; 200/47; 200/153 P

[58] Field of Search ..... 200/5 R, 30 R, 35 R, 200/38 R, 38 B, 39, 153 L, 153 LB, 153 T, 153 P, 153 PA, 47

[56] References Cited

U.S. PATENT DOCUMENTS

| | | | |
|---|---|---|---|
| 2,519,907 | 8/1950 | Hodgson | 200/47 |
| 3,930,131 | 12/1975 | Nishina | 200/35 R |
| 3,937,910 | 2/1976 | Fukami | 200/35 R |
| 4,103,119 | 7/1978 | Homan et al. | 200/35 R |
| 4,171,473 | 10/1979 | Hugin | 200/47 |

*Primary Examiner*—James R. Scott

*Attorney, Agent, or Firm*—Robert E. Burns; Emmanuel J. Lobato; Bruce L. Adams

[57] ABSTRACT

This control device for electric motor-reduction units comprises two cams rotating at different speeds about a common shaft, each cam having only one notch formed in its outer periphery, the cam notches being adapted to cooperate with catch-forming portions of a rocker controlling the motor switch. The first cam is rigid and coaxial with a toothed wheel meshing with a driving toothed pinion pivoted on a shaft parallel to the cam shaft, and comprises two drive teeth adapted, during each revolution, to mesh with a reversing pinion pivoted to the driving pinion shaft and rigid with another pinion meshing with a second toothed wheel rigid with the second cam. The teeth number of this last-mentioned pinion and the teeth number of the second toothed wheel are so selected that the notches cooperate again and simultaneously with the catch forming portions of the rocker only when the second cam moving step by step has accomplished n full revolutions, with n being at least equal to two, during which it has accomplished N full steps, N being not a multiple of n, while the first cam accomplished N full revolutions. This device is intended notably for controlling motor-reduction units driving rolling shutters, roller-blinds or the like.

3 Claims, 6 Drawing Figures

CONTROL DEVICE FOR ELECTRIC MOTOR-REDUCTION UNIT

FIELD OF THE INVENTION

The present invention relates to control devices for electric motor-reduction units of the type intended more particularly for driving the winding rod of a rolling shutter, roller blind or the like, which comprises at least two cams disposed side by side on a common shaft on which they are mounted for free pivotal movement, the outer contours of said cams comprising each a single notch, all the notches of the array of cams being adapted to cooperate simultaneously with a member for controlling a switch for de-energizing the motor. The first cam is coupled kinematically to the motor via a reduction gear so that it will be driven constantly at a relatively low speed, and carries at least two transport teeth adapted, during each cam revolution, to drive through one fraction of a revolution the teeth of a reversing pinion rotating on a shaft parallel to the cam shaft and constantly coupled kinematically to the other cam.

DESCRIPTION OF THE PRIOR ART

In a known control device for electric motor-reduction units three notched cams are used; in fact, since the complete winding up or unrolling of a rolling shutter, roller blind or the like requires about 25 to 30 revolutions of the winding rod, and since, in this known construction, the first cam rotates at a speed corresponding to about twice the speed of the winding rod, this first cam must be capable of performing from about fifty to about sixty revolutions during the operation of the rolling shutter or roller blind, or the like. Now these three cams of the specific prior art construction consist of counter rollers of which the digits are not used; thus, ten revolutions of the first cam cause the second cam to perform a single revolution, and ten revolutions of the second cam cause the third cam to rotate through a single revolution. Thus, three cams are necessary for causing the first cam to accomplish fifty or sixty revolutions.

Of course, it would be possible, as in the present invention, to select a reduction wheel system such that the first cam and the winding rod rotate at substantially the same speed, but nevertheless the 25 or 30 revolutions which the first cam should still accomplish would require the presence of three cams, even if the driving teeth and the corresponding reversing pinions were so modified that one revolution of the second cam required for example fifteen revolutions of the first cam, instead of ten revolutions.

SUMMARY OF THE INVENTION

It is the essential object of the present invention to provide a control device so constructed that the number of revolutions necessary for winding up or unrolling completely a rolling shutter, roller blind or the like, can be obtained while preserving a satisfactory stopping precision of the motor-reduction unit driving the winding rod, while reducing the number of cams implemented in comparison with the prior art, whereby the construction of the control device of this invention is greatly simplified and its overall dimensions are reduced appreciably.

The control device according to this invention is characterized in that it comprises a second toothed pinion laterally rigid with the reversing pinion and in constant meshing engagement with a toothed wheel laterally rigid with the second cam, said second toothed pinion and said toothed wheel having specific teeth numbers. In fact, these teeth numbers are so selected that the respective notches of the first constantly rotating cam and of the second cam rotating step by step do not resume their cooperation with the switch control member until the second cam has accomplished step by step a number n of integral revolutions, with $n \geqq 2$, during which said second cam has accomplished N full steps, N being not a multiple of n, while the first cam accomplished N full revolutions.

DESCRIPTION OF THE PREFERRED EMBODIMENT

Figure 1:
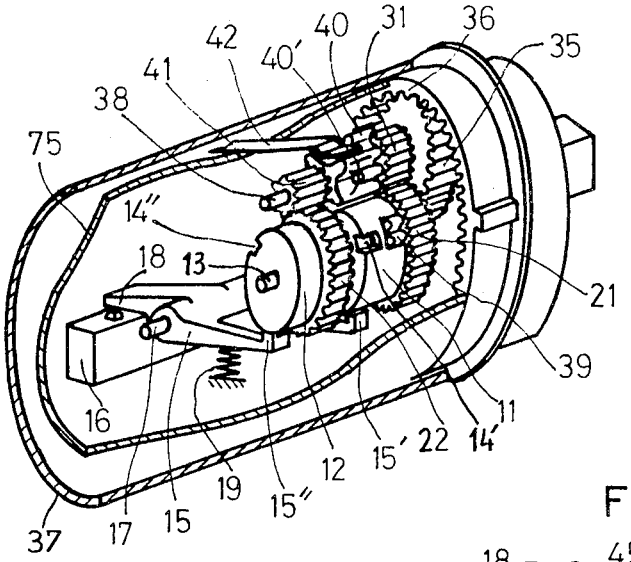
FIG. 1 illustrates diagrammatically in perspective and part-sectional view a typical form of embodiment of a first form of embodiment of the invention.

As illustrated in FIGS. 1 to 6 of the drawing, the control device is incorporated in a tubular-type motor-reduction unit and comprises a pair of cams 11, 12 disposed side by side on a common shaft 13 on which the cams are adapted to rotate freely. The outer contour of each cam 11, 12 comprises a single notch 14', 14'', respectively, adapted to cooperate simultaneously with catches 15', 15'' formed on or carried by a member 15 for controlling the switch 16 inserted in the control circuit (not shown) of the motor-reduction unit. This control member consists in fact of a rocker 15 fulcrumed to a shaft 17 parallel to the cam shaft 13. This rocker 15 also comprises an extension 18 adapted to keep the switch 16 in its open position when all the catches 15', 15'' engage simultaneously the relevant notches 14' and 14''. This switch 16 is normally closed when inoperative or released. A spring 19 (FIG. 1), such as a compression spring, constantly urges the catches 15', 15'' against the contours of cams 11 and 12, respectively.

As illustrated in FIG. 1, the first notched cam 11 comprises a first toothed wheel 21 rigid therewith and disposed laterally and coaxially thereto; this first toothed wheel 21 is in constant meshing engagement with a driving toothed pinion 31 axially rigid with a drive or power pinion 35. This drive pinion 35 is in turn in constant meshing engagement with an internally toothed annulus 36 disposed concentrically to the inner tube 75 of the motor-reduction unit and rigidly coupled to the external winding tube or drum 37. The toothed pinions 31 and 35 are adapted to rotate about a shaft 38 parallel to shafts 13 and 17. In this exemplary form of embodiment the three shafts 13, 17 and 38 are parallel to the inner tube 75 of the motor-reduction unit. Cam 11 has formed in this example, along its outer periphery, a set of drive teeth comprising in this embodiment two teeth 39 adapted, during each revolution of cam 11, to cooperate with a reversing toothed pinion 40 pivoted to shaft 38 and comprising eight teeth in this embodiment. Another toothed pinion 41 laterally rigid with pinion 40 is in meshing engagement with another toothed wheel 22 rigid with the second cam 12 and disposed laterally and coaxially thereto.

Resilient means are also provided for holding the toothed pinion 40 and consequently the assembly comprising the toothed pinion 41, toothed wheel 22 and cam 12 against rotation as long as the pair of driving teeth 39 are not in meshing engagement with toothed pinion 40. The resilient means contemplated consist in this example of a spring blade 42 constantly exerting an elastic pressure against a portion 40' of toothed pinion 40 which has only four teeth, every other tooth being removed therefrom.

In the same exemplary form of embodiment, the internally toothed annulus 36 comprises eighty teeth, pinion 35 has thirty-three teeth, pinion 31 sixteen teeth and the first toothed wheel 21 thirty-nine teeth. With these teeth numbers, the first notched cam 11 rigid with the first toothed wheel 21 will rotate at about the same speed as the winding tube or drum 37 of the rolling shutter, roller blind or like device.

On the other hand, the toothed pinion 41 has twelve teeth, and the second toothed wheel 22 has forty-three teeth. These teeth number are so selected, for instance, that the notches 14', 14" of the first constantly rotating cam 11 and of the second step-by-step rotating cam 12 do not cooperate again simultaneously with catches 15' and 15" of rocker 15 until the second cam 12 has accomplished step-by-step three full revolutions corresponding to forty-three full steps, the first cam 11 having performed during the same time forty-three full revolutions. It will be seen that the selected number of steps, i.e. 43, is not a multiple of the number of revolutions, i.e. 3, accomplished by the second cam 12 during the same time period; thus, still in this example, one revolution of second cam 12 corresponds to $43:3=14\frac{1}{3}$ steps of the same second cam.

Figure 2:
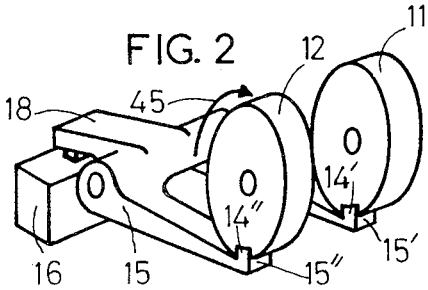
FIGS. 2 to 6 are fragmentary perspective views showing the notched cams of the same form of embodiment but in the positions obtained at different stages of the operation of the motor-reduction unit control device.

Now let us consider an initial or starting position in which the various component elements of the control device are in the positions shown in FIG. 2. The notch 14' of first cam 11 is then aligned with catch 15' so that the latter is engaged therein, and at the same time the notch 14" of second cam 12 is aligned with catch 15" so that the latter is engaged therein. Switch 16 is held open by spring 19. The motor (not shown) is deenergized and therefore stopped. It can be started by actuating another switch, and when the first cam 11 rotates relatively rapidly, notch 14' will move the catch 15' outwardly so that switch 16 will be released in its closed position.

Figure 3:
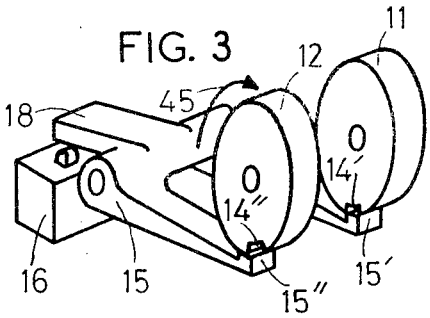
Figure 4:
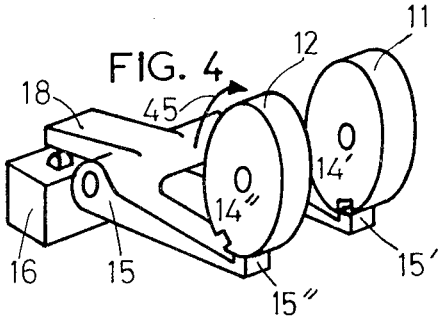

When cam 11 has been rotated in direction 45 during fourteen full revolutions, and its notch 14' registers with catch 15', the notch 14" of second cam 12 has performed fourteen full steps and thus been delayed by one-third of a step with respect to its position of proper alignment with catch 15", as shown in FIG. 3. When notch 14' has accomplished a fifteenth revolution, the notch 14" will have accomplished another step and will have a lead corresponding to two-thirds of a step (FIG. 4).

Figure 5:
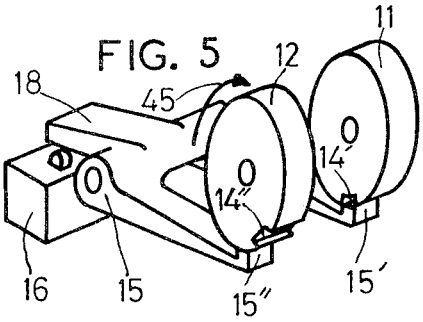
Figure 6:
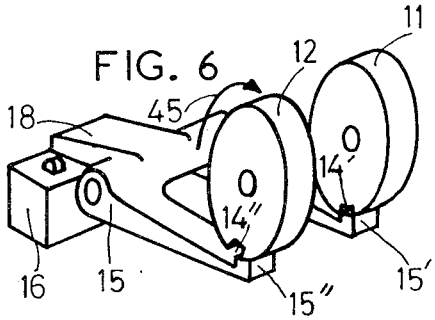

When the first cam 11 has accomplished twenty-eight full revolutions in the direction 45 and its notch 14' registers with catch 15', the notch 14" of second cam 12 will have accomplished an angular movement corresponding to twenty-eight full steps and will therefore have a lag of two-thirds of a step with respect to its position of proper alignment with catch 15", as illustrated in FIG. 5. When said notch 14' has completed its twenty-ninth revolution, notch 14" will have accomplished another step and will thus lead by one-third of a step, as shown in FIG. 6.

When the first cam 11 has accomplished forty-two full revolutions in the direction of the arrow 45, and its notch 14' registers with catch 15', the notch 14" of second cam 12 has been moved through forty-two full steps and has a one-step delay with respect to a proper alignment with catch 15". When the notch 14' and the first cam 11 have accomplished the forty-third and last revolution, notch 14" has finished its forty-third and last step, and is again in proper alignment with the catch 15", as shown in FIG. 2.

Due to the force of spring 19, both catches 15' and 15" drop back into the relevant notches 14' and 14", respectively, and the extension 18 of rocker 15 moves the control member of switch 16 to the open-switch position. Thus, the motor is deenergized and the rotational movement of the winding tube or drum 37 is also stopped.

This control device is particularly advantageous in that, when the second cam 12 accomplished its last forward step, both cams 11 and 12 rotate in unison and at that time at a relatively fast speed, so that the motor is stopped swiftly and accurately.

In actual practice, the number of revolutions, i.e. forty-three in this example, may be accomplished by the first cam and the corresponding number of steps may be performed by the second cam, and are selected to be high enough to enable the unrolling, or the winding up, respectively, of the rolling shutter, roller blind or the like to be completed before said number of revolutions is completed; the position of cams 11, 12 in which the notches 14', 14" thereof register with their associated catches 15', 15" corresponding for example to a position in which the rolling shutter, roller blind or the like is fully wound up. Another exactly similar control device is generally utilized for determining the position in which the rolling shutter, roller blind or the like is fully unrolled.

The control device according to this invention may be used for controlling an electric motor-reducing unit for rotatably driving a rolling shutter, a roller blind or the like.

What is claimed is:

1. A control device for an electric motor speed-reducing unit intended for rotatably driving a winding rod of a rolling shutter, roller blind or the like which comprises a first shaft; first and second cams disposed side-by-side on said first shaft and freely rotatable thereon, each of said cams having in its periphery a single notch, switch means controlling the energizing circuit of the electric motor of said unit, switch actuating means comprising a control member biased into contact with the peripheries of said first and second cams and operable to actuate said switch means only when said control member engages in said notches of both of said cams simultaneously, reduction drive means kinematically coupling said first cam to said electric motor to rotate constantly when said motor is running, said first cam having on its periphery at least two drive teeth, a first pinion rotatable on a second shaft parallel to said first shaft having teeth engageable by said drive teeth on said first cam to drive said first pinion one step each revolution of said first cam, a second pinion coaxial with and rotating with said first pinion and a toothed wheel coaxial with and fixed to said second cam, said toothed wheel meshing with and being driven by said second pinion, whereby said toothed wheel and second cam are rotated step-by-step as said first cam rotates continuously, said second pinion and said toothed wheel having numbers of teeth such that the notches of said first constantly rotating cam and said second cam rotating step-by-step, starting from a condition in which said control member engages said notches in both cams, do not again reach such condition until said second cam has accomplished step-by-step a number n of full revolutions which is at least equal to two during which it has performed N steps, while said first cam has performed N full revolutions, N not being a multiple of n.

2. A control device according to claim 1, in which said first pinion has fewer teeth than said second pinion.

3. A control device according to claim 1 or claim 2, in which said control member is pivoted about a third shaft parallel to said first shaft and has two parallel arms having nose portions engaging peripheries of said first and second cams respectively.

* * * * *